US010624480B2

(12) United States Patent
Garretson

(10) Patent No.: US 10,624,480 B2
(45) Date of Patent: Apr. 21, 2020

(54) BRASSIERE HANGER

(71) Applicant: Jean Ann Garretson, Evansville, IN (US)

(72) Inventor: Jean Ann Garretson, Evansville, IN (US)

( * ) Notice: Subject to any disclaimer, the term of this patent is extended or adjusted under 35 U.S.C. 154(b) by 185 days.

(21) Appl. No.: 15/845,009

(22) Filed: Dec. 18, 2017

(65) Prior Publication Data

US 2018/0168380 A1 Jun. 21, 2018

Related U.S. Application Data

(60) Provisional application No. 62/437,320, filed on Dec. 21, 2016.

(51) Int. Cl.
*A47G 25/14* (2006.01)
*A47G 25/18* (2006.01)
*A47G 25/20* (2006.01)

(52) U.S. Cl.
CPC ..... *A47G 25/1442* (2013.01); *A47G 25/18* (2013.01); *A47G 25/20* (2013.01); *A47G 2025/1492* (2013.01)

(58) Field of Classification Search
CPC .... A47G 25/1442; A47G 25/18; A47G 25/20; A47G 2025/1492; A47G 25/14; A47G 25/145; A47G 25/1457; A47G 25/183; A47G 25/186; A47G 25/48; A47G 25/486; Y10T 24/392; Y10T 24/3931; Y10T 24/3998; D06F 59/02
USPC ..... 223/88, 84, 85, 91
See application file for complete search history.

(56) References Cited

U.S. PATENT DOCUMENTS 2,514,742 A * 7/1950 Burger ..... A47G 25/1457 211/113
2,815,157 A * 12/1957 Badgley ..... A47G 25/441 223/66
5,556,013 A * 9/1996 Mayer ..... D06F 95/006 223/1
6,471,102 B2 * 10/2002 Hancock ..... A47G 25/20 223/84
7,252,573 B2 * 8/2007 Mann ..... D06F 59/02 223/66

* cited by examiner

*Primary Examiner* — Anna K Kinsaul
*Assistant Examiner* — F Griffin Hall
(74) *Attorney, Agent, or Firm* — Oliff PLC; R. Brian Drozd

(57) ABSTRACT

Devices and systems for hanging brassieres are provided. In one embodiment, a brassiere hanging system comprises a support device and at least one brassiere hanger element. Each brassiere hanger element is configured to support a brassiere. The support device is configured to be connected with and support the at least one brassiere hanger element. According to one embodiment, a brassiere hanger element may comprise a body component and at least one spiral connector extending from a top portion of the body component.

13 Claims, 9 Drawing Sheets

BRASSIERE HANGER

CROSS-REFERENCE TO RELATED APPLICATIONS

The present application is a non-provisional application of U.S. provisional patent application No. 62/437,320, titled "Bra Hanger" and filed on Dec. 21, 2016.

BACKGROUND

Generally, clothing may be stored in dressers or in chests of drawers and is often hung on clothes hangers or coat hangers. The clothes hangers can then be hung from a closet rod, coat hanger rod, or other horizontal rod within closets, clothes cabinets, or within other similar types of areas. Also, many types of accessories, such as belts, ties, scarves, hats, and other items may be hung from devices that are specifically designed for the particular type of accessory. For instance, hat racks may be designed for holding hats and may be mounted on doors and walls or may be designed as free-standing devices.

However, with the multitude of devices for storing or hanging clothes and/or accessories, the designs of these devices are not particular suited for use with brassieres. Even conventional clothes hangers are primarily designed to hang shirts, jackets, and pants, but cannot properly handle brassieres. Likewise, conventional scarf holders, tie racks, belt racks, and hat racks are not able to properly support a brassiere. As a result, women must resort to simply placing brassieres for storage in a regular drawer.

However, some brassieres may include support wires, which may prevent brassieres from being able to easily fit into small spaces, such as drawers. If forced into small drawers, the support wires of brassieres may become bent or may puncture the material of the brassiere. Therefore, a need exists for women to have a way to hang brassieres such that the brassieres are not damaged and can maintain their proper shape.

SUMMARY

Systems and devices for storing, hanging, and/or supporting brassieres are disclosed in the present disclosure. According to one embodiment, a brassiere hanging system is provided with a support device and at least one brassiere hanger element, where each brassiere hanger element is configured to support a brassiere. The support device is configured to be connected with and support the at least one brassiere hanger element.

Brassiere hanger elements are also described in the present disclosure. In one embodiment, a brassiere hanger element includes a body component and at least one spiral connector extending from a top portion of the body component.

BRIEF DESCRIPTION OF THE DRAWINGS

Aspects of the present invention are described in the detailed description which follows in reference to the drawings by way of non-limiting examples of embodiments of the present invention in which like reference numerals represent similar parts throughout the several views of the drawings and wherein.

DETAILED DESCRIPTION

Figure 1:
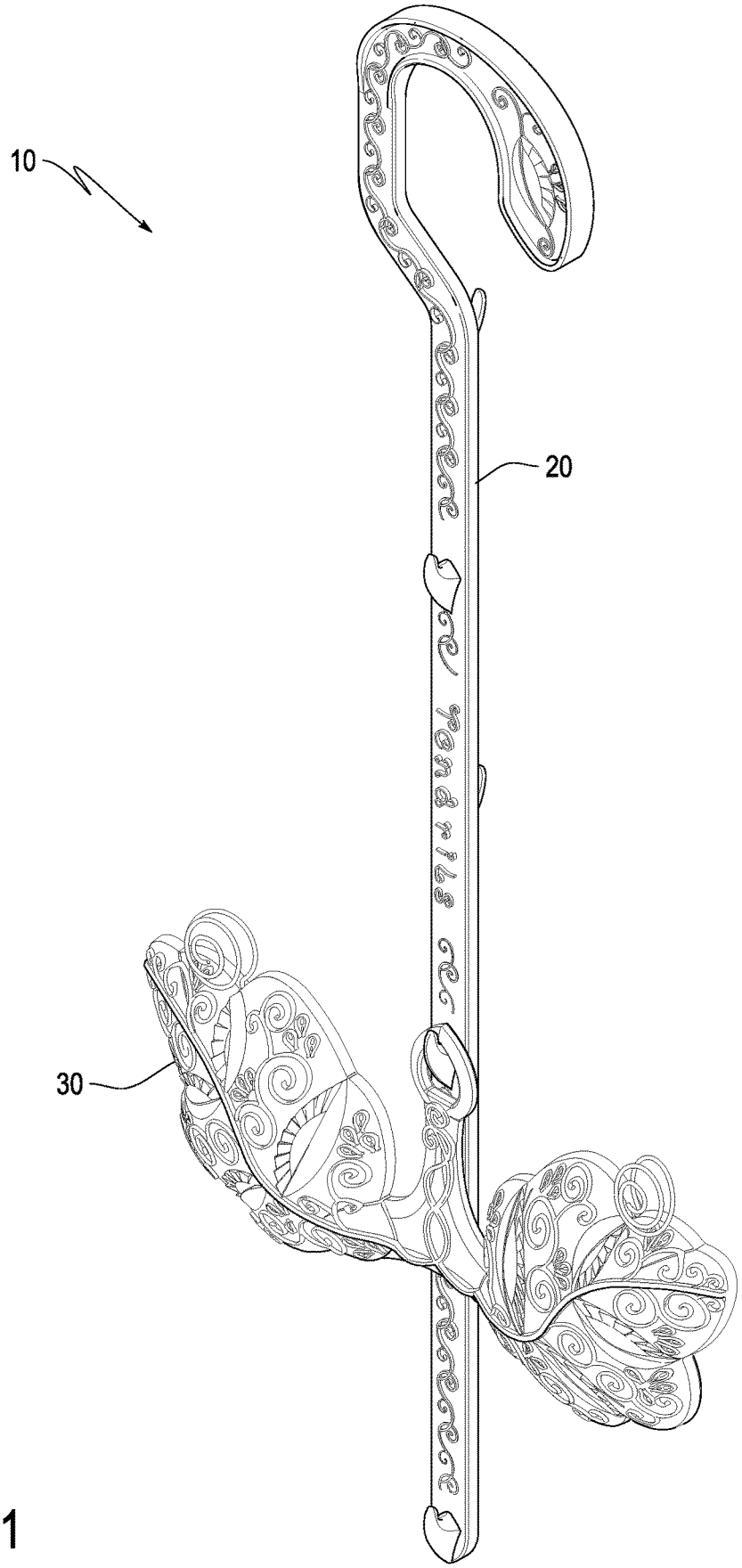
FIG. 1 illustrates a front view of a brassiere hanging system, according to one embodiment.

FIG. 1 shows a front view of an embodiment of a brassiere hanging system 10. In this embodiment, the brassiere hanging system 10 comprises a support device 20 and one or more brassiere hanger elements 30. As illustrated in FIG. 1, only one brassiere hanger element 30 is attached to the support device 20. However, it should be noted that a plurality of brassiere hanger elements 30 may be attached to the support device 20 at one time. Each brassiere hanger element 30 is configured to support a single brassiere, as explained in more detail below.

Figure 2:
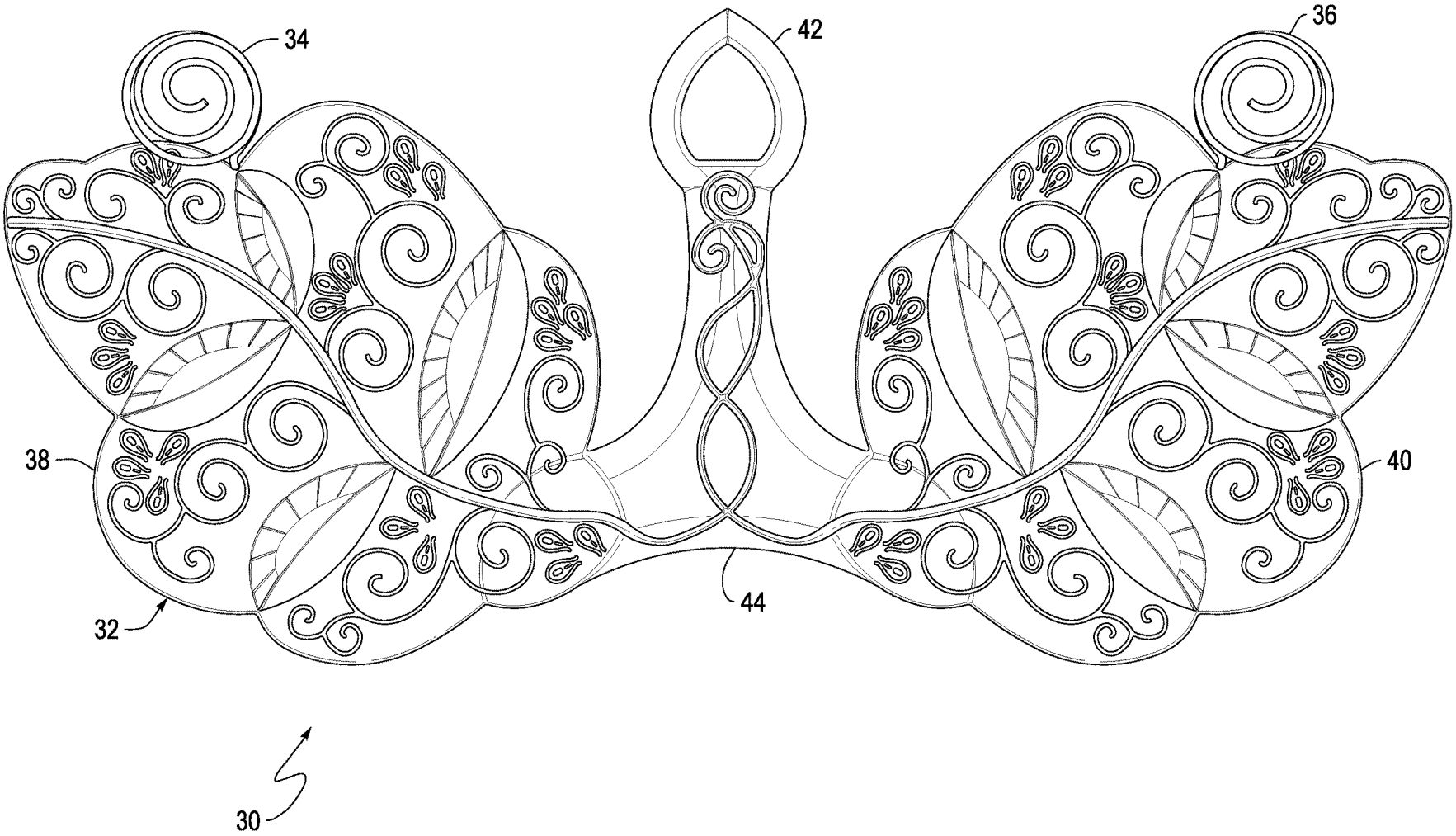
FIG. 2 illustrates a front view of a brassiere hanger element of the brassiere hanging system of FIG. 1, according to one embodiment.
Figure 3:
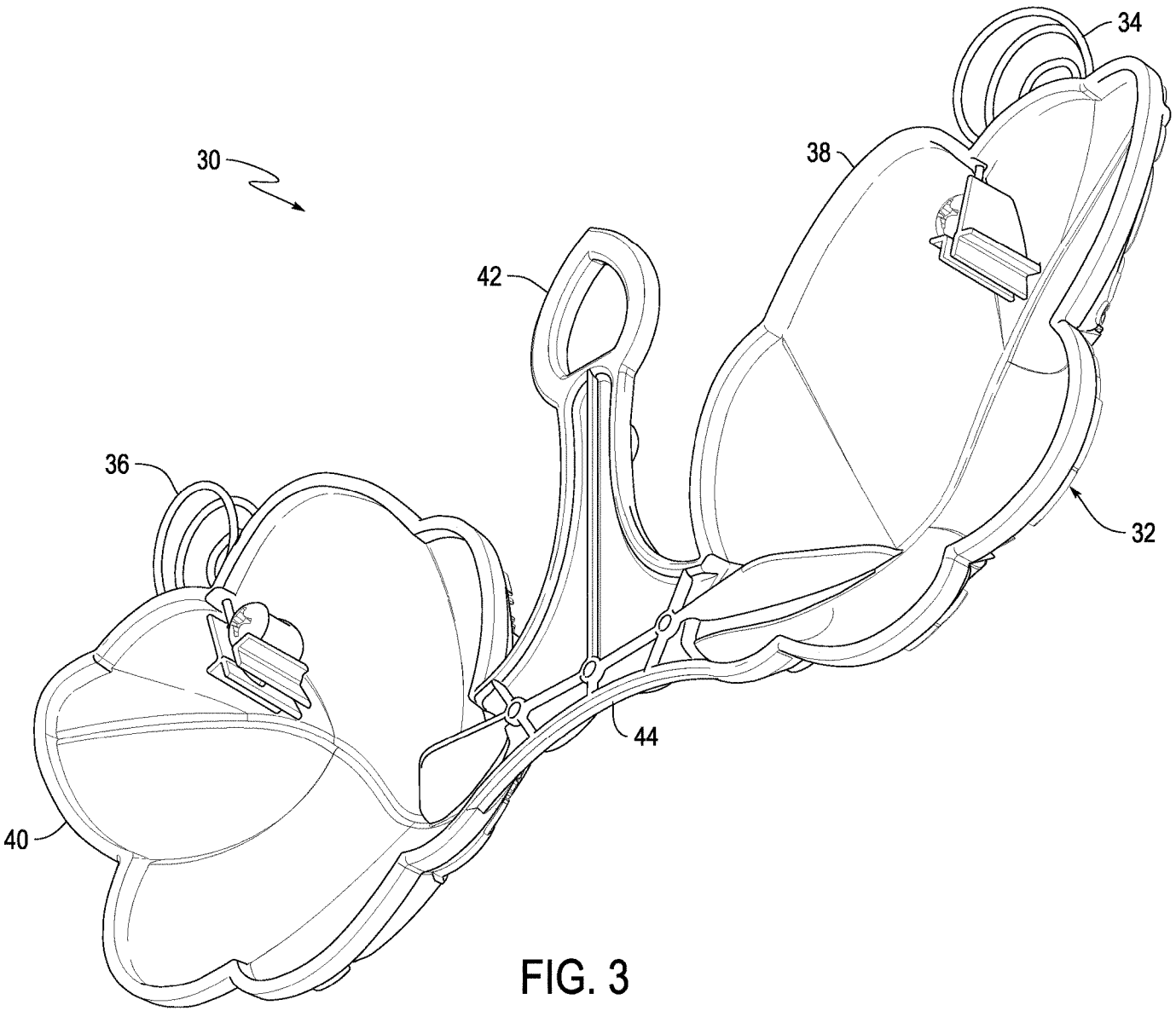
FIG. 3 illustrates a back perspective view of the brassiere hanger element of FIG. 2, according to one embodiment.

FIGS. 2 and 3 show a front view and a back perspective view, respectively, of the brassiere hanger element 30 shown in FIG. 1. As shown in this embodiment, the brassiere hanger element 30 includes a body component 32, a first spiral connector 34, and a second spiral connector 36. The first and second spiral connectors 34, 36 are configured to extend upward from a top portion of the body component 32. Also, the coils of the spiral connectors 34, 36 extend slightly forward.

The body component 32 includes a first cupped support element 38, a second cupped support element 40, a connector portion 42, and an intermediate portion 44. In some embodiments, the entire body component 32 may be formed as a single integral piece and may be formed of plastic or other suitable material. The intermediate portion 44 is configured to hold the first cupped support element 38, second cupped support element 40, and connector portion 42 together.

The first spiral connector 34 extends from a top portion of the first cupped support element 38 of the body component 32. The second spiral connector 36 extends from a top portion of the second cupped support element 40 of the body component 32. As shown in FIG. 3, an end of each of the spiral connectors 34, 36 is inserted through an opening in the top portions of the cupped support elements 38, 40, respectively, and is held in place by a screw.

Figure 4A:
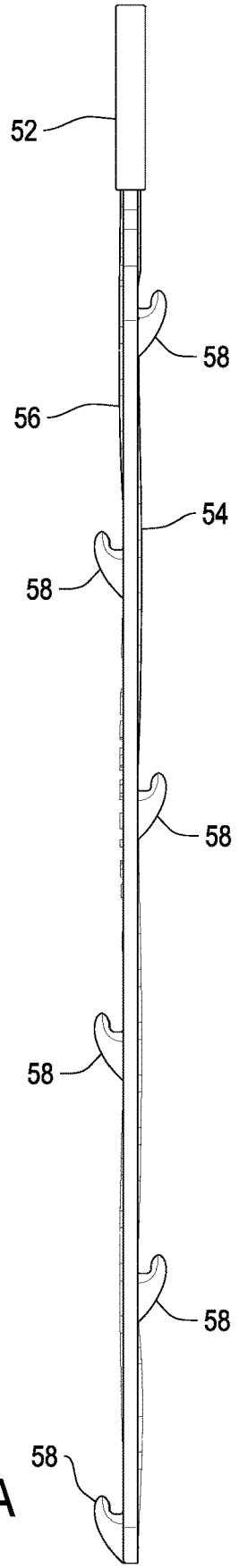
FIG. 4A illustrates a side view of a support device of the brassiere hanging system of FIG. 1, according to one embodiment.
Figure 4B:
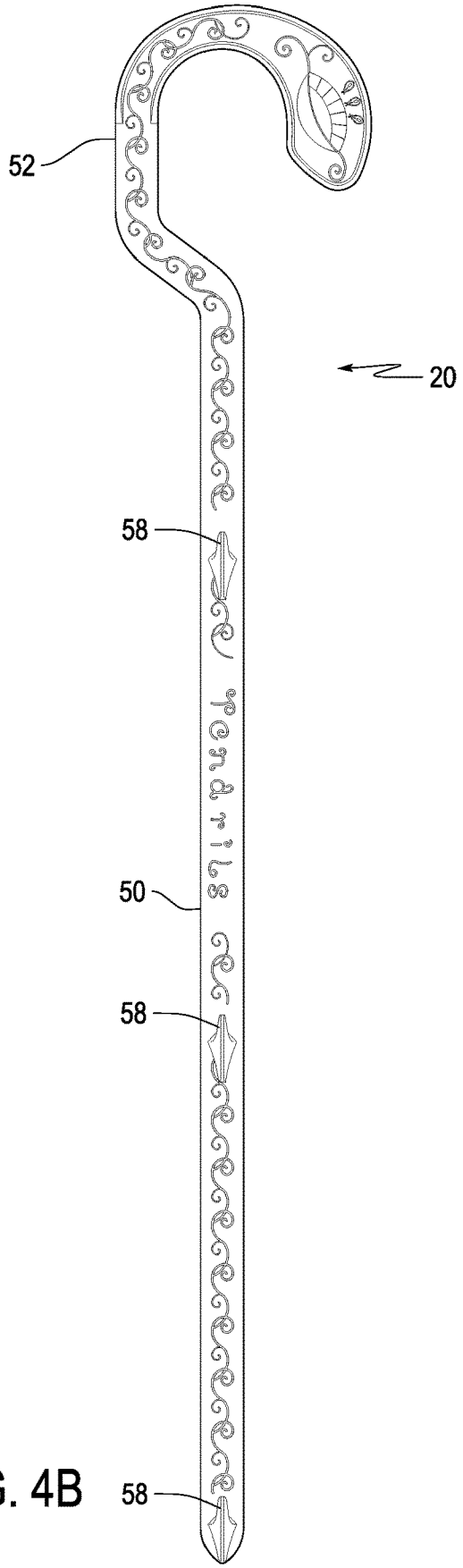
FIG. 4B illustrates front view of the support device of FIG. 4A, according to one embodiment.

FIGS. 4A and 4B illustrate a side view and front view, respectively, of an embodiment of the support device 20 of the brassiere hanging system 10. The support device 20 includes an elongated body 50 and a hanging element 52. When the hanging element 52 is engaged with a horizontal rod (e.g., closet rod), the elongated body 50 is configured to be suspended downward from the hanging element 52.

In some embodiments, the hanging element 52 may be a hook. In an alternative embodiment, the hanging element 52 may include a support element having a rectangular design that is configured to be clipped onto and/or supported by a top portion of a door. In another alternative embodiment, the handing element 52 may include a relatively flat structure with a screw opening that is configured to be screwed onto a surface of a wall or door.

The elongated body 50 suspends from the hanging element 52 and includes one or more connectors 58, each of which is configured to connect with the connector portion 42 of the brassiere hanger element shown in FIGS. 2-3. The connectors 58 of the elongated body 50 of the support device and the connector portions 42 of the body components 32 of the brassiere hanger elements 30 are configured to easily engage with each other. Also, the connectors 58 and connector portions 42 may include snapping elements to allow them to be snapped together, which may provide for a more secure connection. In some embodiments, connectors 58 may be configured as hooks and the connector portions 42 may be configured as loops, which may allow a user to easily hang the brassiere hanger element 30 onto the support device 20. With the ability to connect and disconnect multiple brassiere hanger elements 30 on the support device 20, a user can easily rearrange the brassiere hanger elements 30 as desired on any of the connectors 58.

As illustrated in FIG. 4A, at least one connector 58 may be attached to or extend from a front side 54 of the elongated body 50 of the support device 20 while at least one connector 58 may be attached to or extend from a back side 56 of the elongated body 50. In the embodiments shown in FIG. 4A, three connectors 58 are connected to the front side 54 and three connectors 58 are connected to the back side 56.

The connectors 58, as illustrated, include hooks, which may have any suitable shape for allowing the brassiere hanger elements 30 to hang therefrom. According to other embodiments, the connectors 58 may include clips, clasps, or other types of fasteners.

Figure 5:
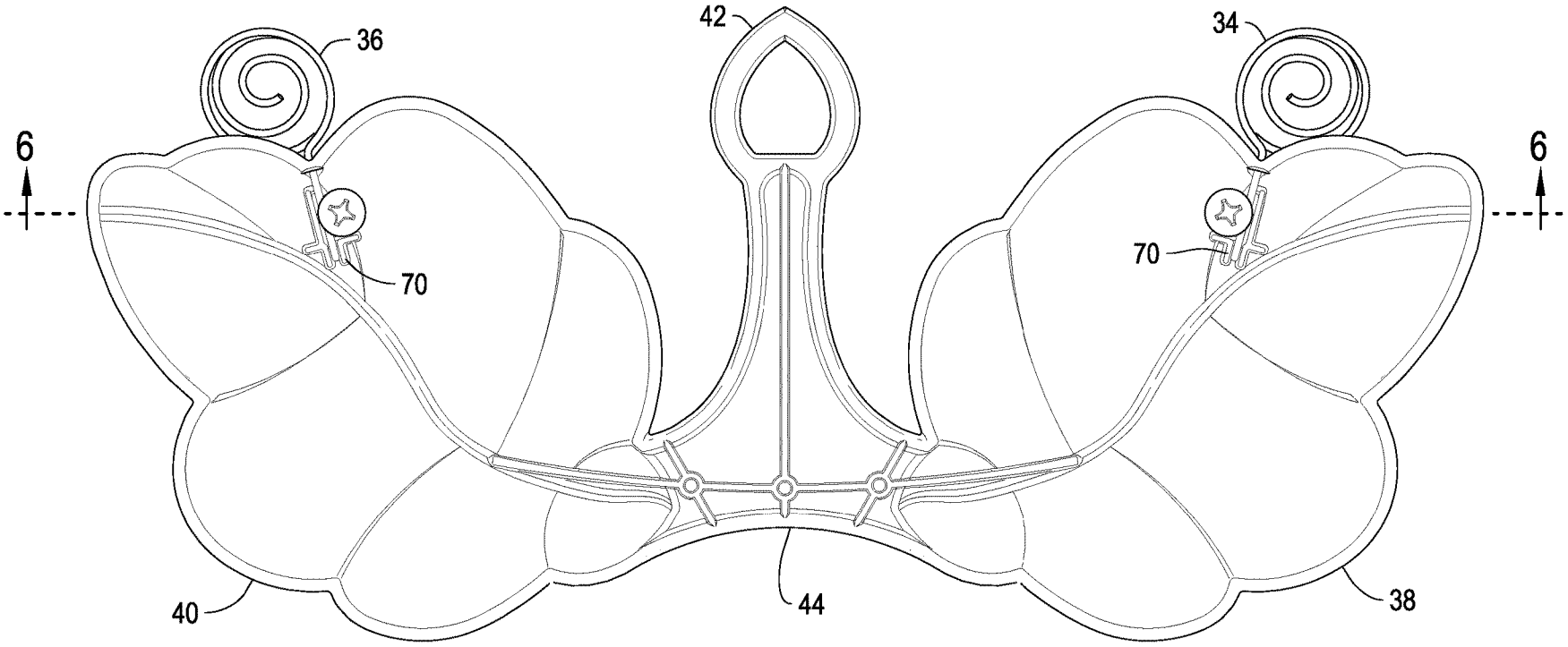
FIG. 5 illustrates a back view of the brassiere hanger element of FIG. 2, according to one embodiment.
Figure 6:
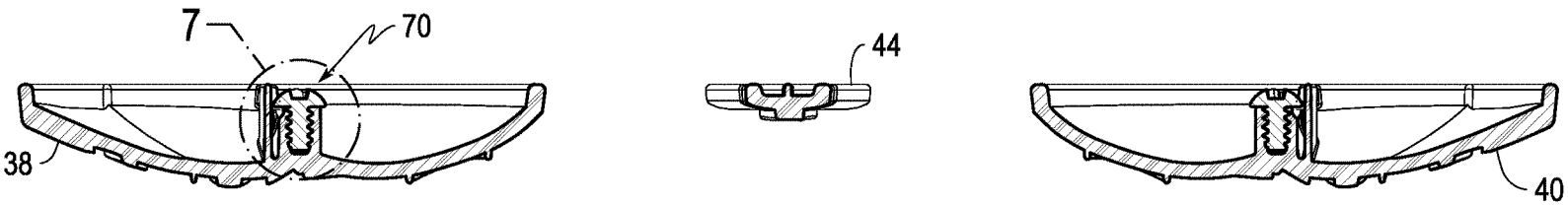
FIG. 6 illustrates a cross-sectional side view of the brassiere hanger element taken along line B-B of FIG. 5, according to one embodiment.
Figure 7:
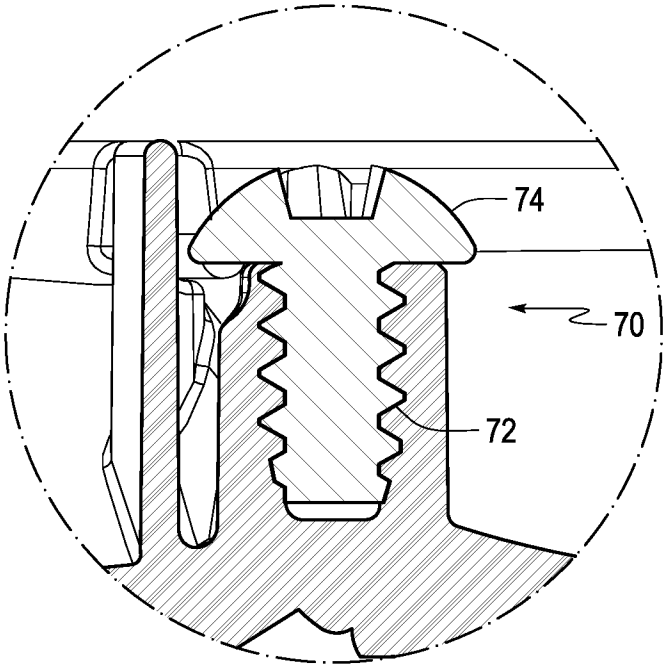
FIG. 7 illustrates a sectional side view showing section C indicated in FIG. 6, according to one embodiment.

FIG. 5 is a back view of the brassiere hanger element 30. FIG. 6 is a cross-sectional side view of the brassiere hanger element 30 taken along the dashed lines of FIG. 5. FIG. 7 is a sectional side view showing the circled section indicated by the dashed lines in FIG. 6. Each cupped support element 38, 40 includes a screw support structure 70. The screw support structures 70 are configured for securing the first and second spiral connectors 34, 36 to the first and second cupped support elements 38, 40, respectively.

The screw support structure 70 includes, among other things, components that form a screw opening 72 into which a screw 74 can be screwed. During manufacturing of the brassiere hanger element 30, an end of each of the spiral connectors 34, 36 is inserted through an opening 76 (see FIG. 10) in a top portion of the respective cupped support element 38, 40. The end may then be inserted in an opening in the screw support structure 70. A screw 74 is then screwed into the screw opening 72. As the screw 74 is tightened in the screw opening 72, the screw 74 contacts a portion of the spiral connector 34, 36 and holds the spiral connector 34, 36 securely in place.

Figure 8:
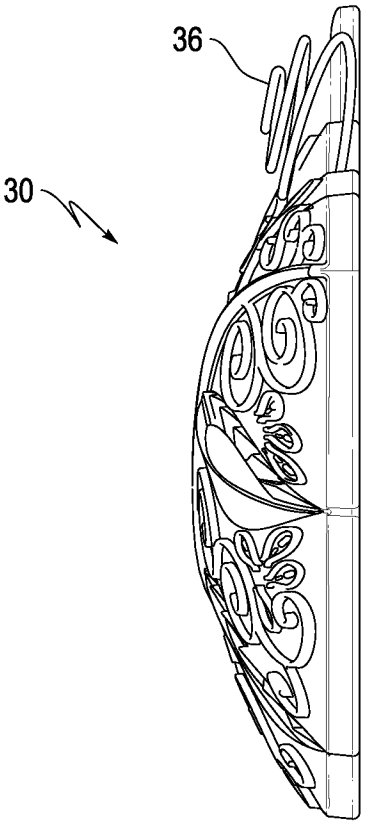
FIG. 8 illustrates a side view of the brassiere hanger element of FIG. 2, according to one embodiment.

FIG. 8 shows a side view of the brassiere hanger element 30. When each spiral connector 34, 36 is secured in the top portion of the body component 32 of the brassiere hanger element 30, the spiral connector 34, 36 includes a portion that extends out toward the front. During use of the brassiere hanging system 10, a user may insert a strap of a brassiere in between the coils of the spiral connector 34, 36, which is configured to provide a resistive pressure on the strap sufficient to the hold the strap. A cup of the brassiere being hung will be suspended from the strap, which is supported by the spiral connector 34, 36. Thus, the cup may be held over the cupped support element 38, 40 of the brassiere hanger element 30. The cupped support elements 38, 40 may be configured to keep the form of the brassiere, as opposed to a brassiere that might be simply stored in a drawer.

Figure 9:
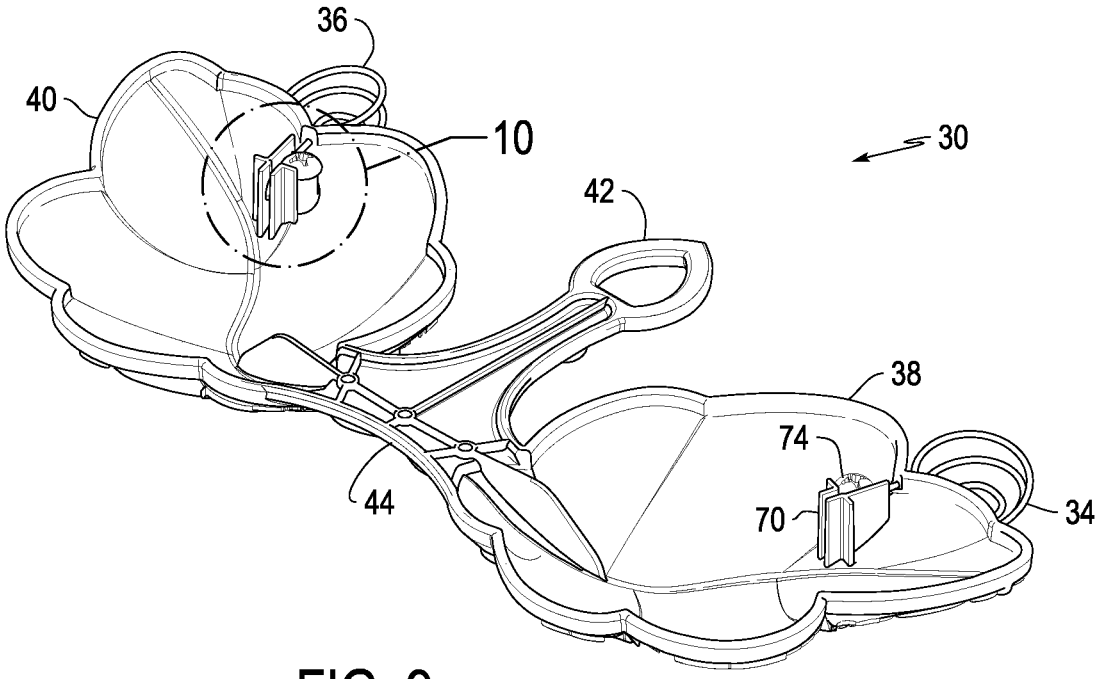
FIG. 9 illustrates a back perspective view of the brassiere hanger element of FIG. 2, according to one embodiment.
Figure 10:
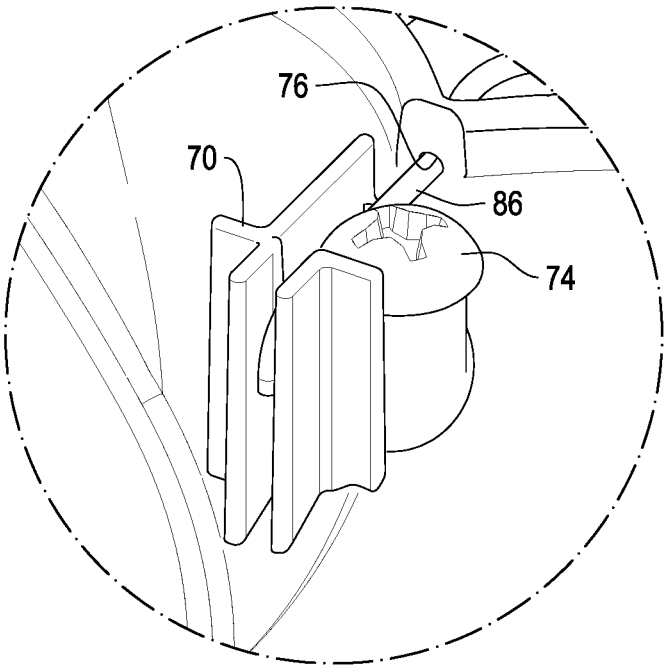
FIG. 10 illustrates a sectional perspective view showing section A indicated in FIG. 9, according to one embodiment.

FIG. 9 illustrates a back perspective view of the brassiere hanger element 30. FIG. 10 is a sectional perspective view showing the circled section indicated by the dashed lines in FIG. 9. An extension portion 86 of the spiral connector 34, 36 is inserted through an opening 76 in a top portion of the brassiere hanger element 30. An end of the extension portion 86 may be held between the screw 74 and a portion of the screw support structure 70 when the screw 74 is engaged with the screw opening 72 of the screw support structure 70. In some embodiments, the screw support structure 70 may additionally or alternatively include a channel or other component in which the extension portion 86 may be securely inserted.

Figure 13:
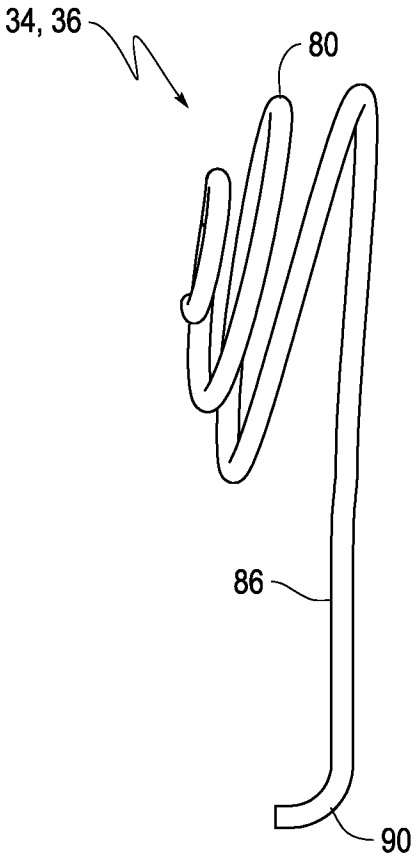
FIGS. 11, 12, and 13 illustrate perspective, front, and side views of a spiral connector of the brassiere hanger element, according to some embodiments.
Figure 12:
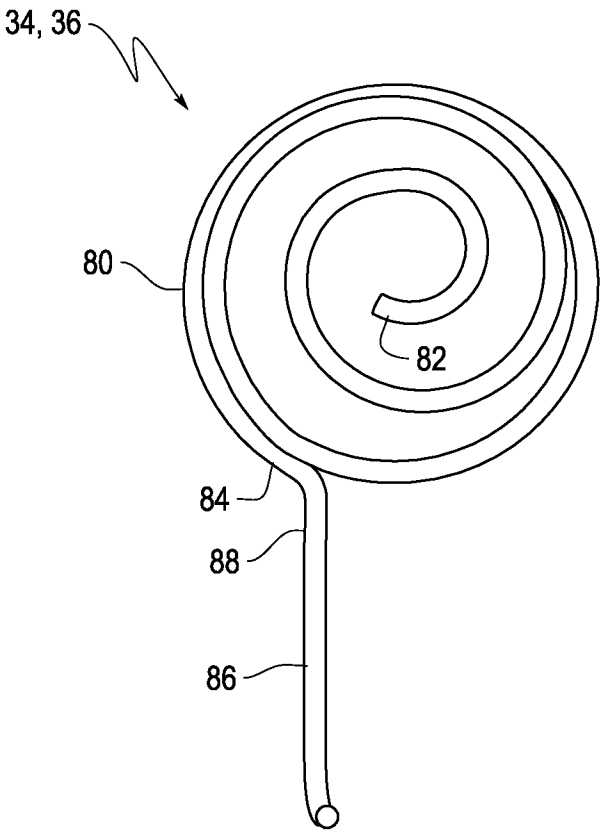
Figure 11:
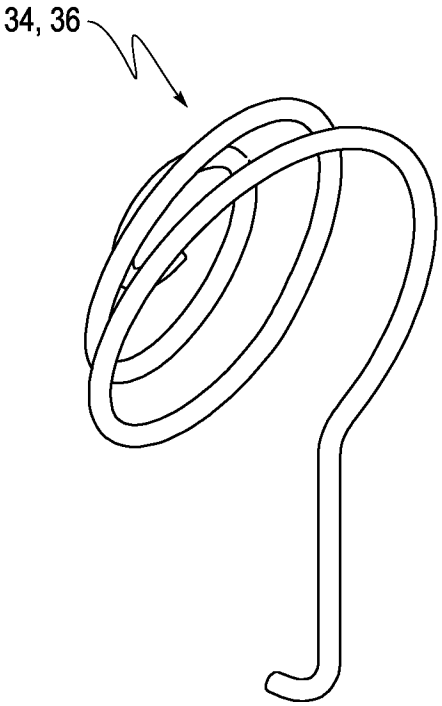

FIGS. 11, 12, and 13 show perspective, front, and side views, respectively, of one of the spiral connectors 34, 36 of the brassiere hanger element 30. According to some embodiments, the spiral connector shown in FIGS. 11-13 may represent one of the two spiral connectors 34, 36, wherein the other of the two spiral connectors 34, 36 may be a formed as a mirror image of the other. In other embodiments, both of the spiral connectors 34, 36 may have the same form, such as the same clockwise spiraling of the wires as shown in FIGS. 11-13, or may both have a counterclockwise spiraling of the wires.

In the illustrated embodiment, the spiral connector 34, 36 includes a conical helix portion 80 having an inner end 82 and an outer end 84. The spiral connector 34, 36 also includes an extension portion 86 connected at a first end 88 to the outer end 84 of the conical helix portion 80. The other end of the extension portion 86 may include an angled end 90. In some embodiments, the angled end 90 may be inserted into an opening in the screw support structure 70 before the screw 74 is tightened over the top of the extension portion 86.

The spiral connectors 34, 36 may include any suitable material (e.g., metal) that is bent or formed to include the design shown in FIGS. 11-13 (or a mirror image thereof). The spiral connectors 34, 36 may include a circular cross-section having a small diameter, thereby allowing the spiral connectors 34, 36 to have sufficient rigidity to support a strap of a brassiere while also having sufficient flexibility to allow the strap to be inserted and removed without difficulty for the user.

In some embodiments, the inner end 82 of the conical helix portion 80 of the spiral connector 34, 36 may be crimped or bent back against an adjacent coil. In this way, any sharp edges of the inner end 82 might not be exposed, but may be held against an adjacent coil to form a small loop. With this arrangement, the inner end 82 will be less likely to catch or snag the material of the brassiere or straps thereof.

In order to secure the first and second spiral connectors 34, 36 to the first and second cupped support elements 38, 40, respectively, the angled end 90 of the extension portion 86 of the spiral connector 34, 36 is inserted through the opening 76 in the top portion of the respective cupped support element 38, 40. Then, the extension portion 86 is pulled through the opening 76 until the first end 88 of the extension portion 86 is at or near the opening 76. The angled end 90 may then be inserted into an opening in the screw support structure 70 and the screw 74 is threaded into the screw opening 72 until the screw 74 is tightened onto a side of the extension portion 86 to keep the spiral connection 34, 36 in place.

Figure 14:
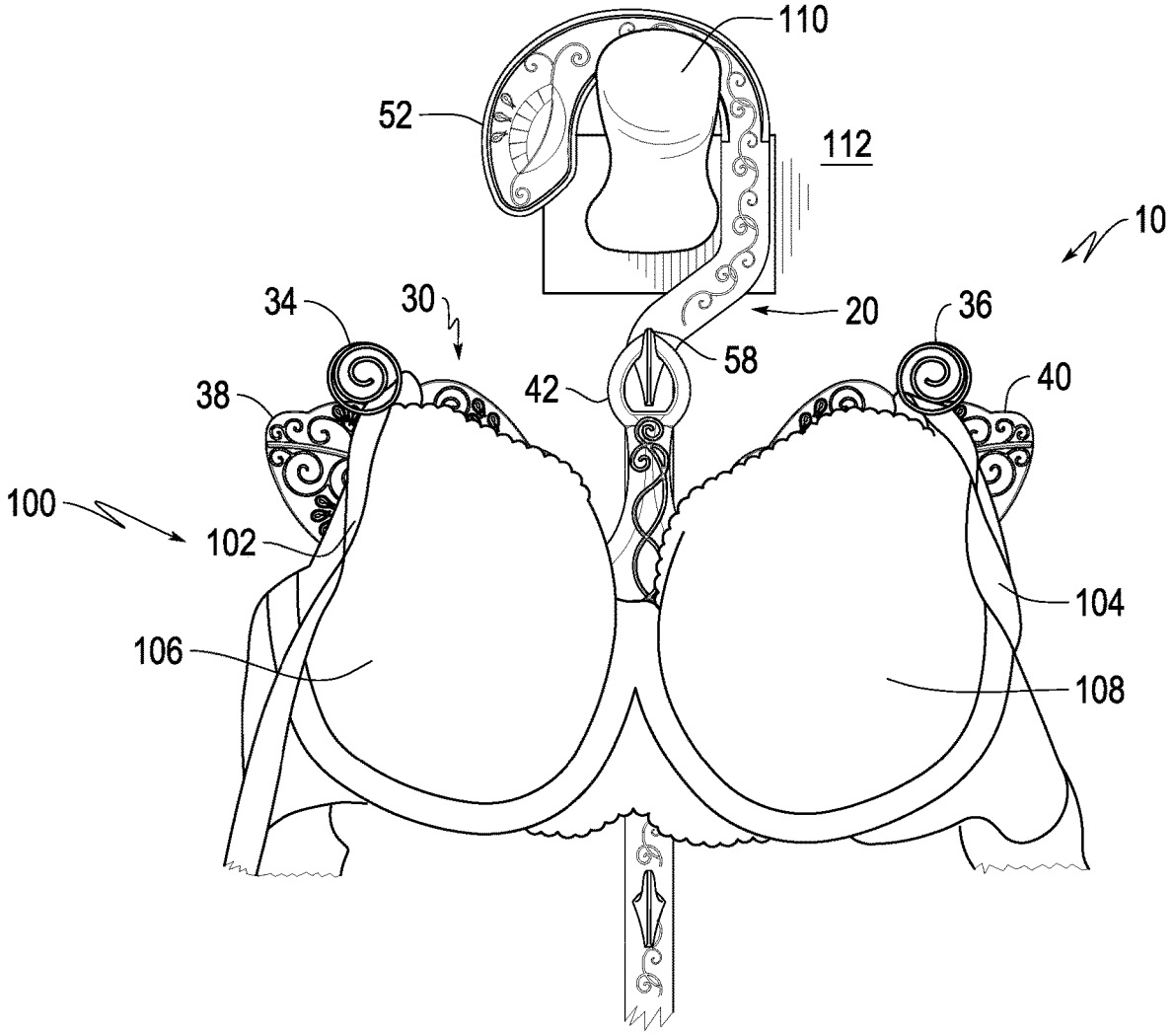
FIG. 14 illustrates a perspective front view of a brassiere attached to the brassiere hanger system of FIG. 1, according to one embodiment.

FIG. 14 illustrates a perspective front view of a brassiere 100 that is attached to the brassiere hanger system 10. As shown, the brassiere 100 includes a first strap 102 that is inserted in between the coils of and held by the first spiral connector 34 extending from the top portion of the first cupped support element 38. The brassiere 100 also includes a second strap 104 that is inserted in between the coils of and held by the second spiral connector 36 extending from the top portion of the second cupped support element 40. With the straps 102, 104 inserted in the spiral connectors 34, 36, the cups 106, 108 of the brassiere 100 are suspended from the supported straps 102, 104 such that the cups 106, 108 lie over the first and second cupped support elements 38, 40, respectively.

Furthermore, FIG. 14 shows that the connector portion 42 (e.g., loop) of the brassiere hanger element 30 is positioned on the corresponding connector 58 (e.g., hook) of the support device 20 and therefore supported by the support device 20. Also, the hanging element 52 (e.g., hook) is shown as being engaged with a knob 110 connected to a wall 112. In other embodiments, the hanging element 52 may be engaged with a horizontal rod, hook, or other structure within a closet and/or attached to a door or wall. The brassiere hanging system 10 is configured to allow a user to hang one or more brassieres thereon in a secure fashion while the brassiere hanging system 10 itself is hung up, such as on a closet rod.

It should be understood that the brassiere hanger elements 30, in some embodiments, may be integrated with the support device 20 so that the brassiere hanger elements 30 are not removable from the support device 20. In other embodiments, the brassiere hanger elements 20 may be removably attached to the support device 20 by hanging each brassiere hanger element 30 on one of the connectors 58 (e.g., hooks) of the support device 20.

As illustrated, each brassiere hanger element 30 includes two spiral connectors 34, 36. However, in other embodiments, a brassiere hanger element 30 may include just one spiral connector. In still other embodiments, a brassiere hanger element 30 may include any number of spiral connectors. With multiple spiral connectors on a single brassiere hanger element 30, a plurality of spiral connectors may be used to engage with one single strap of a brassiere or multiple spiral connectors may be used to engage with multiple brassieres.

Each spiral connector 34, 36 is formed such that a spiral space exists between the coils of the spiral connector. Also, the spiral connector 34, 36 may be attached to the cupped support elements 38, 40, by any suitable type of fastener, such as the screw support structure 70 (and corresponding elements) shown in the embodiments of FIGS. 6, 7, and 10.

The spiral connectors 34, 36 may each comprise a wire formed in the shape of a conical helix, as illustrated, wherein the wire extends horizontally toward a forward direction of the body component 32 of the brassiere hanger element 30. Thus, the wire may extend perpendicularly away from a place that is generally defined by the circles of the spiral, if the spiral were formed in a plane, rather than conically. In other embodiments, the spiral connectors 34, 36 may have wires formed in a spiral pattern within a plane.

In use, the straps 102, 104 of the brassiere 100 are attached to the brassiere hanging system 10. The straps 102, 104 may be inserted in the spiral space between the coils of the spiral connectors 34, 36 and "caught" between the spiral connectors 34, 36. Also, the straps 102, 104 may be pulled through the spiral connectors 34, 36 to catch the straps 102, 104 when pulled in one direction and then caught again when pulled in a different direction.

According to some embodiments, a method of attachment of a right side of the brassiere 100 may be performed by a user. The method may include: (1) holding the first cupped support element 38 of the brassiere hanger element 30 in the user's left hand and holding the second strap 104 of the brassiere 100 in the user's right hand, (2) placing the strap 104 on a left side of the spiral connector 36, and (3) pulling the strap 104 down or toward the user so that the strap is held or catches between the spiral connector 36 and the second cupped support element 38. Additionally, attaching the left side of the brassiere 100 may simply include the same method, but reversed, as with the right side.

In addition to decorative brassieres 100 as shown in FIG. 14, the brassiere hanging system 10 may also be configured to support sports bras and other types of brassieres. The spiral connectors 34, 36 may be configured to hold the straps of a sports bra in a paper clip type fashion. The straps of other types of brassieres may also be held by the spiral connectors 34, 36 in a paper clip type fashion and/or may be draped over the outer portion of the conical helix portion 80. The straps may also be interwoven through the coils of the spiral connectors 34, 36. In this regard, the spiral connectors 34, 36 may be used in any desired fashion or any combination of methods as the consumer sees fit.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to embodiments of the invention in the form disclosed. Many modifications and variations will be apparent to those of ordinary skill in the art without departing from the scope and spirit of embodiments of the invention. The embodiment was chosen and described in order to best explain the principles of embodiments of the invention and the practical application, and to enable others of ordinary skill in the art to understand embodiments of the invention for various embodiments with various modifications as are suited to the particular use contemplated.

Although specific embodiments have been illustrated and described herein, those of ordinary skill in the art appreciate that any arrangement which is calculated to achieve the same purpose may be substituted for the specific embodiments shown and that embodiments of the invention have other applications in other environments. This application is intended to cover any adaptations or variations of the present invention. The following claims are in no way intended to limit the scope of embodiments of the invention to the specific embodiments described herein.

The invention claimed is:

1. A brassiere hanging system comprising:

a support device; and at least one brassiere hanger element, each brassiere hanger element configured to support a brassiere;

wherein the support device is configured to be connected with and support the at least one brassiere hanger element, wherein each of the at least one brassiere hanger elements comprises a body component and at least one spiral connector extending from a top portion of the body component, wherein each of the at least one spiral connectors of each of the at least one brassiere hanger elements comprises a conical helix portion configured to engage with a strap of a brassiere such that cups of the brassiere suspend from the supported strap and are cupped by the body component, wherein each of the at least one spiral connectors further comprises an extension portion extending from an outer end of the conical helix portion, and wherein the body component comprises at least one screw opening configured to engage with at least one screw, and wherein the at least one screw is configured to hold the extension portions of the at least one spiral connector.

2. The brassiere hanging system of claim 1, wherein the support device comprises an elongated body and a hanging element, and wherein the elongated body suspends downward from the hanging element.

3. The brassiere hanging system of claim 2, wherein the elongated body comprises at least one connector configured for connection with at least one corresponding connector portion of the at least one brassiere hanger element.

4. The brassiere hanging system of claim 3, wherein the elongated body comprises a plurality of connectors, at least one of the connectors connected to a front side of the elongated body, and at least one of the connectors connected to a back side of the elongated body.

5. The brassiere hanging system of claim 4, wherein each of the plurality of connectors is a hook, and wherein the corresponding connector portion of each of the at least one brassiere hanger element is a loop.

6. The brassiere hanging system of claim 2, wherein the hanging element of the support device is a hook configured to engage a horizontal rod from which the brassiere hanging system is suspended.

7. The brassiere hanging system of claim 1, wherein the body component of each of the at least one brassiere hanger elements comprises first and second cupped support elements, a connector portion, and an intermediate portion, and wherein the intermediate portion is configured for holding the first cupped support element, the second cupped support element, and the connector portion together.

8. The brassiere hanging system of claim 7, wherein the at least one spiral connector of each of the at least one brassiere hanger elements includes first and second spiral connectors, the first spiral connector extending from a top portion of the first cupped support element, and the second spiral connector extending from a top portion of the second cupped support element.

9. The brassiere hanging system of claim 7, wherein the connector portion of the body component of each of the at least one brassiere hanger elements comprises a loop that engages with a corresponding connector element of the support device.

10. A brassiere hanger element comprising:

a body component; and at least one spiral connector extending from a top portion of the body component, wherein each of the at least one spiral connectors comprises a conical helix portion configured to engage with a strap of a brassiere such that cups of the brassiere suspend from the supported strap and are cupped by the body component, wherein each of the at least one spiral connectors further comprises an extension portion extending from an outer end of the conical helix portion, and wherein the body component comprises at least one screw opening configured to engage with at least one screw, and wherein the at least one screw is configured to hold the extension portion of the at least one spiral connector.

11. The brassiere hanger element of claim 10 wherein the body component comprises first and second cupped support elements, a connector portion, and an intermediate portion, the intermediate portion configured for connecting together the first cupped support element, the second cupped support element, and the connector portion.

12. The brassiere hanger element of claim 11, wherein the at least one spiral connector includes first and second spiral connectors, the first spiral connector extending from a top portion of the first cupped support element, and the second spiral connector extending from a top portion of the second cupped support element.

13. The brassiere hanger element of claim 11, wherein the connector portion of the body component comprises a loop that engages with a corresponding connector element of a brassiere hanging system.

* * * * *